US005305557A

United States Patent [19]

Warncke

[11] Patent Number: 5,305,557

[45] Date of Patent: Apr. 26, 1994

[54] PUNCH AND DIE REGRIND FIXTURE

[76] Inventor: Lee A. Warncke, 178 Englewood Dr., Orange, Conn. 06477

[21] Appl. No.: 944,594

[22] Filed: Sep. 14, 1992

[51] Int. Cl.[5] ..... B24B 41/06

[52] U.S. Cl. ..... 51/216 R; 51/220; 51/217 R; 51/216 P; 51/217 P; 269/902; 269/156; 269/279

[58] Field of Search ..... 51/216 R, 216 P, 217 R, 51/217 P, 216 LP, 216 A, 217 A, 217 L, 220; 269/9, 10, 43, 44, 277, 279, 280, 902, 155, 156

[56] References Cited

U.S. PATENT DOCUMENTS

| | | | |
|---|---|---|---|
| 1,705,629 | 3/1929 | Wildbore | 51/220 |
| 2,362,306 | 11/1944 | Ringzelli | 51/220 |
| 2,612,821 | 10/1952 | Skay | 51/217 R |
| 3,136,101 | 6/1964 | Hanna | 51/217 R |
| 3,376,674 | 4/1968 | Ernesto | 51/220 |
| 4,748,774 | 6/1988 | Giangrasso | 51/217 |

*Primary Examiner*—Bruce M. Kisliuk
*Assistant Examiner*—Eileen P. Morgan
*Attorney, Agent, or Firm*—Robert A. Seemann

[57] ABSTRACT

A block having first and second permanent cavities. The first cavity includes a first vertical, continuous V-groove from the rop of the block to a pocket which has a permanent horizontal bottom wall. The second cavity includes a second V-groove that is parallel to the first V-groove, and which is continuous from the top of the block to a second permanent horizontal bottom wall that is at a predetermined height with respect to the bottom wall of the first cavity. Each cavity includes a bar pivotally attached to the block, which includes a flat surface for pressing normally to the bottom of the V-groove, along a vertical line of contact with the vertical cylindrical portion of a tool in the V-groove when the bar is positioned horizontally across the V-groove and is drawn to the block.

10 Claims, 3 Drawing Sheets

FIG. 1
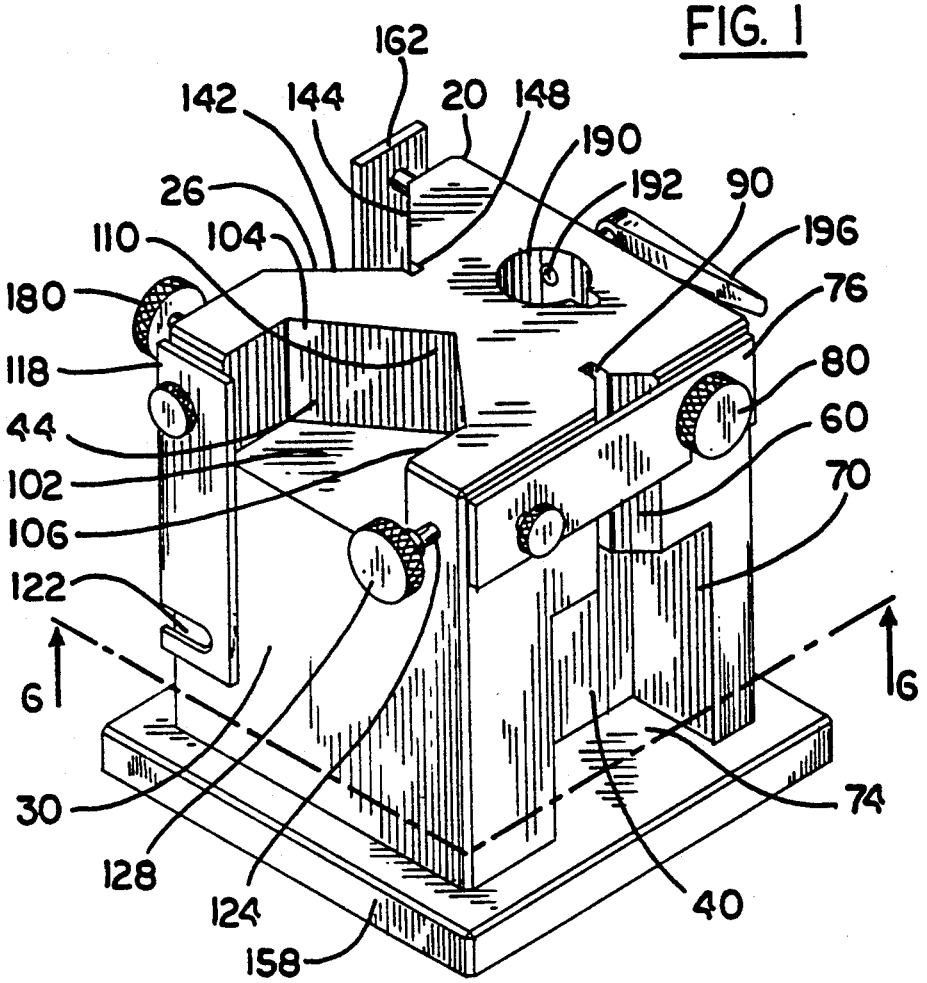
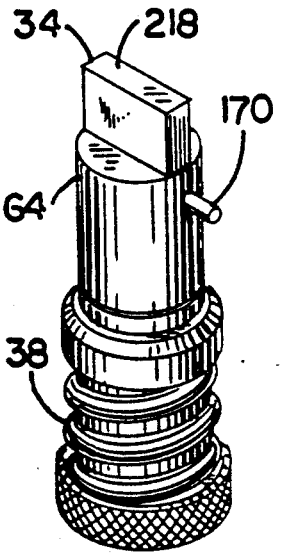
FIG. 2
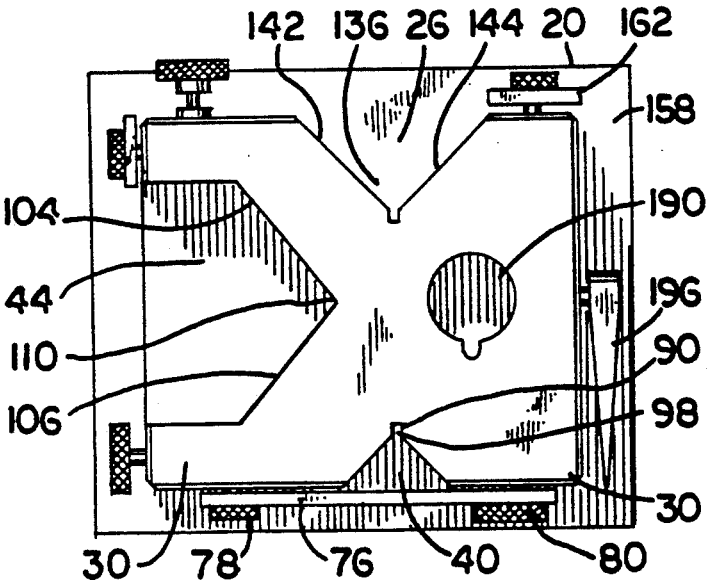
FIG. 3

PUNCH AND DIE REGRIND FIXTURE

BACKGROUND OF THE INVENTION

1. Field of the Invention.

The present invention relates in general, to work holders for abrading operations, more particularly to a work holder for grinding a punch and a die for cutter faces in parallel planes, in the same operation, square to each other's axis, simply, quickly, and accurately.

2. Description of the Prior Art

Sharpening a punch and die set commonly involves grinding the elements in separate uncoordinated set-up operations. To grind the punch, the spring, spring support, and spring retainer nut are stripped from the punch. The punch shaft is then clamped in a grinder vise adjusted so that the axis of the shaft is perpendicular to the axis of the grinding wheel shaft. The cutter face of the punch shaft is then progressively traversed by the outer diameter of the grinding wheel until it is square with the axis of he shaft. The punch is then reassembled.

The die is ground similarly by securing it on a magnetic grinder plate and adjusting so that the axis of the die is perpendicular to the axis of the grinding wheel shaft. The cutter face of the die is then progressively traversed by the outer diameter of the grinding wheel until it is square with the axis of the shaft.

The grind must result in the cutter faces of the punch and die being true to one another, that is, in parallel planes when they are aligned face-to-face on a common axis.

One tool designed for holding a work piece is described in U.S. Pat. No. 1,705,629, patented by W.H. Wildbore, Mar. 19, 1929. The block has a first longitudinally extending V-groove which is interrupted between its ends by a transversely extending groove. Also, a transverse recess is formed at one end of the block in a second block or plate, that is attached to the first block, extending normally from the first block rearward of the bottom of the V-groove. Longitudinally extending grooves on each side of the first block slidingly receive the ends of a U-shaped yoke for pressing the work-piece into the first groove by means of a screw through the yoke which bears upon the work-piece. The transversely extending grooves accommodate flanges or peripheral projections on the work-piece.

U.S. Pat. No. 3,376,674, patented Apr. 9, 1968 by A.M. Ernesto describes a fixture for holding and positioning a punch or tool bit for grinding surfaces on the tool at angles related to the surfaces and the tool.

The fixture includes a plate that is suitable for holding by a magnetic chuck of a grinder. The plate has a vertical central pin and a pair of opposed horizontal pins one at each longitudinal end of the plate. A longitudinal block having a series of threaded vertical apertures along its length, rests on the plate, rotatably mounted by the vertical pin on the plate. A downward extending pin through one end of the longitudinal block limits the extent of rotation of the longitudinal block by interception of one of the horizontal pins.

A tool clamping block member is mounted on the longitudinal block for sliding movement along the longitudinal block. The tool clamping member includes at one end of the clamping member a vertical slit having a longitudinal top bearing surface for receiving a hold down bolt. This allows the clamping block member to be clamped ar any location along the length of the longitudinal block by bolting down at the closest threaded vertical aperture.

At the other end of the member, on a line parallel with the longitudinal block, is a vertically oriented V-channel, straddled by a horizontal semicircular yoke or bridge that is bolted to the clamping block member. A fastening screw through the top of the yoke clamps the tool in the clamping block member by bearing on the side of the tool, pressing the tool directly into the V groove.

To set the height of the tool more accurately in the clamping member, an alternate base is provided with a line of threaded vertical apertures ending with a smooth bore vertical aperture. The threaded apertures are for clamping the clamping block member to the alternate base by a hold down bolt as described above, positioned so that the vertical V-groove is over the smooth bore vertical aperture. A pin of selected length is inserted in the smooth bore vertical aperture for supporting the tool at a predetermined height with respect to the alternate base, whereupon the tool is clamped against the V-groove by the fastening screw.

U.S. Pat. No.

4,748,774, patented Jun. 7, 1988 by J.A. Giangrasso, discloses a fixture for holding each pin of a batch injection mold injector pins for grinding, so that each pin is ground to a length identical with the others.

A plate suitable for holding by a magnetic chuck of a grinder includes a perpendicular jaw block at one end. A movable stop member is slidingly mounted on a shaft that is rigidly attached perpendicularly to the jaw block, so that the stop member can traverse the plate, to and from the jaw block.

The head of the pin to be ground abuts the movable stop member which is adjusted to a position along the shaft and locked in place on the shaft by a set screw when the straight end of the pin is moved by the stop member to set the pin tip at a predetermined position with respect to the grinding wheel. The pin is clamped on the jaw block, by the straight end, close to the tip, by a V-groove on the block, and an angled clamp face which urges the pin into the apex of the V-groove as it is closed on the pin by a thumb screw attached to the block.

Once the set-up is made, a second pin is ground like the first by resting the head on the stop member, and clamping the straight end of the pin in the V-groove by using the angled clamp arrangement for the V-groove.

SUMMARY OF THE INVENTION

It is one object of the invention to provide a punch and die grinding fixture that holds a punch assembly and a matching die for grinding in one set-up.

It is another object to provide a punch and die grinding fixture that holds the punch complete with its assembled spring head assembly.

It is another object of the present invention to provide a punch and die grinding fixture that holds the punch and die in parallel V-grooves, each tool by a line-contact clamp which presses the tool in the groove.

It is yet another object to provide in the above punch and die grinding fixture, direct insertion loading and line contact fastening of the tool in the fixture for simple, quick, and repeatable positioning and locking of the tool in the fixture.

It is another object to provide a punch and die grinding fixture that positions the cutter surfaces of the punch assembly and die for grinding in parallel planes.

Still another object of the invention is to hold a dressing post in correct orientation with respect to the punch and die, for properly dressing a wheel for grinding the punch and die cutter faces in the fixture.

In the invention, a block includes first and second permanent cavities machined in the block.

The first cavity includes a first vertical V-groove in its upper portion for receiving the shank of a punch, and a pocket in the lower portion of the cavity for receiving, with clearance, the spring head assembly of the punch. The pocket includes a first permanent horizontal bottom wall for supporting the spring head of the punch. A trough, running the full length of the V-groove which extends continuously from the top of the block to the pocket, surrounds, and is spaced throughout from the apex of the V-groove.

The second cavity, for receiving a die, includes a second vertical V-groove having an axis that is parallel to the axis of the first vertical V-groove, and a second permanent horizontal bottom wall that is of predetermined height with respect to the first bottom wall. A trough, running the full length of the second V-groove which extends continuously from the top of the block to the second bottom wall, surrounds, and is spaced throughout from the apex of the V-groove.

The height of the second permanent horizontal bottom wall with respect to the first permanent horizontal wall is predetermined so that the front cutter faces of the punch and die are above the first and second cavities when the punch and die are mounted in the fixture with the backs of the punch and die respectively against the first and second horizontal bottom walls.

First and second means for pressing, each preferably being a bar comprising a flat surface for pressing respectively the punch shank and the die into the respective first and second V-grooves by bearing in a vertical contact line that is generally normal to the center of the V-groove along a portion of the shank and the die, are attached to the block pivotally so that each bar can wiggle slightly to establish the line contact, and can rotate in a vertical arc to a horizontal position across the V-groove.

The V-groove walls have widths such that the outer surface of the tool that is enclosed in the groove, be it the punch shank or the die, is in tangential contact with both walls of the groove and with the means for pressing.

BRIEF DESCRIPTION OF THE DRAWINGS

In order that the invention be more fully comprehended, it will now be described, by way of example, with reference to the accompanying drawings, in which:

FIG. 1 is a perspective view of a punch and die grinding fixture constructed according to the present invention.

FIG. 2 is a perspective view of a punch assembly.

FIG. 3 is a top view of the punch and die grinding fixture shown in FIG. 1.

DESCRIPTION OF THE PREFERRED EMBODIMENTS

Figure 4:
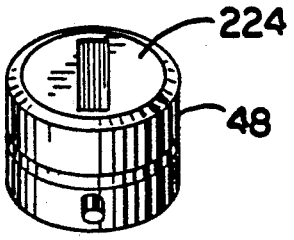
FIG. 4 is perspective view of a matching die to the punch of FIG. 2.
Figure 5:
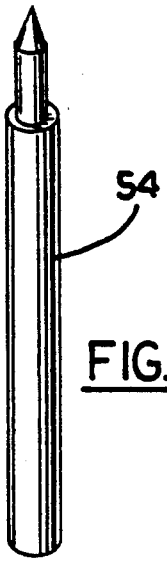
FIG. 5 is a respective view of a diamond dressing post.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring now to FIGS. 1 through 5, Punch and die grinding fixture 20 includes permanent cavities 26 and 40 which are machined into fixture block 30.

Cavity 26 is for receiving standard 1-¼" punch 34, assembled with spring head assembly 38.

Cavity 40 is for receiving ½" standard punches, or a dressing post such as diamond dressing post 54, or standard ⅝" punches, with the help of a spacer (not shown).

Referring to FIGS. 1, 2, 3, 6, and 8, cavity 40 includes angled walls 56 and 58 which form V-groove 60 for receiving a punch shank such as shank 64 of punch 34. Walls 56 and 58 are preferably angled 90 degrees, but may be angled from 75 to 105 degrees from one another.

Cavity 40 also includes pocket 70 which is wider and deeper then V-groove 60, in order to receive with clearance, a punch spring head assembly such as spring head assembly 38 of punch 34.

Permanent bottom horizontal wall 74 of the cavity supports the spring head assembly of a punch that is installed in cavity 40.

Figure 8:
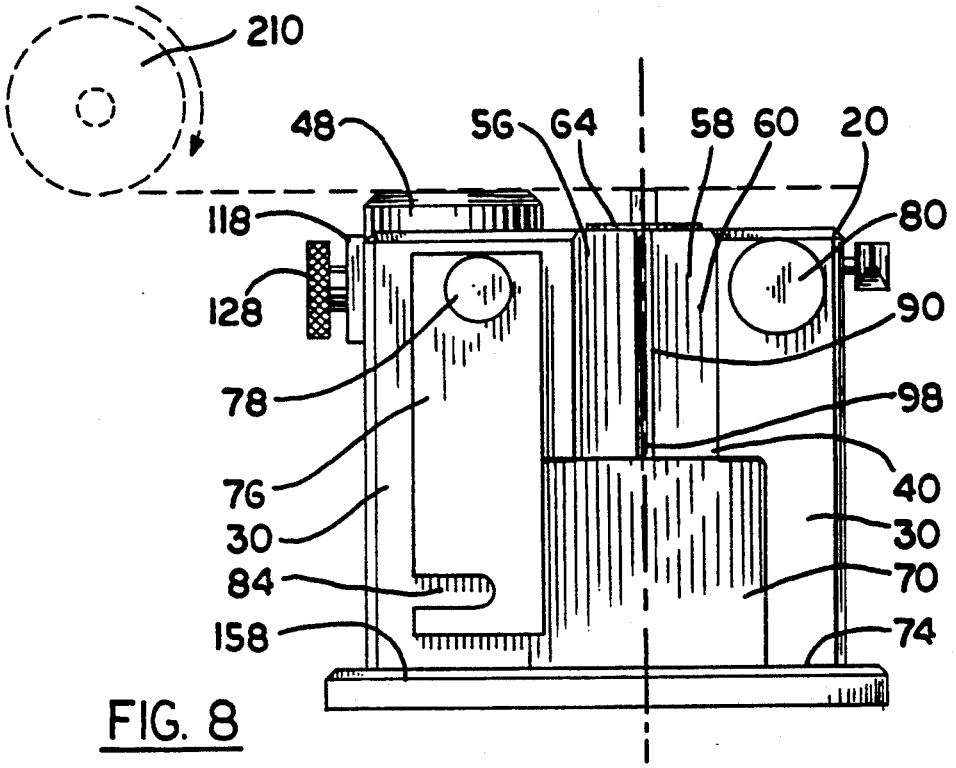
FIG. 8 is a front view of the punch and die mounted in the fixture with the punch cutter face set close to the same plane as the punch cutter face, for grind of both faces in the same set-up. The grinding wheel (shown in phantom) is adjusted separately for each face.

As shown in FIG. 8, pressing bar 76 is pivotally attached to block 30 by screw 78 which provides enough space between bar 76 and block 30 for the bar to pivot or wiggle slightly on the screw. This may be accomplished by a shoulder bolt and spacer, for example. Screw 78 also allows bar 76 to rotate in a vertical arc so that it may be rotated across to thumb screw 80 where slot 84 permits the bar to fall between the head of screw 80 and block 30, with the bar resting in a horizontal position. Screw 80 draws bar 76 toward block 30. When in this horizontal position, the face of bar 76 which is toward block 30 and which is located over the V-groove, is flat.

Trough 90 surrounds and is spaced throughout from the apex 98 or line of virtual intersection of walls 56 and 58 of V-groove 60, preferably for the full length of that line of intersection. The V-groove is preferably uniform, continuous, and unbroken along its full length.

Permanent cavity 44 is for receiving die 48 which rests on bottom wall 102 of cavity 44, and is pressed against walls 104 and 106 of V-groove 110 by pressing bar 118 when the bar is rotated to the horizontal with slot 122 on shaft 124, and drawn toward block 30 by thumb screw head 128.

Figure 6:
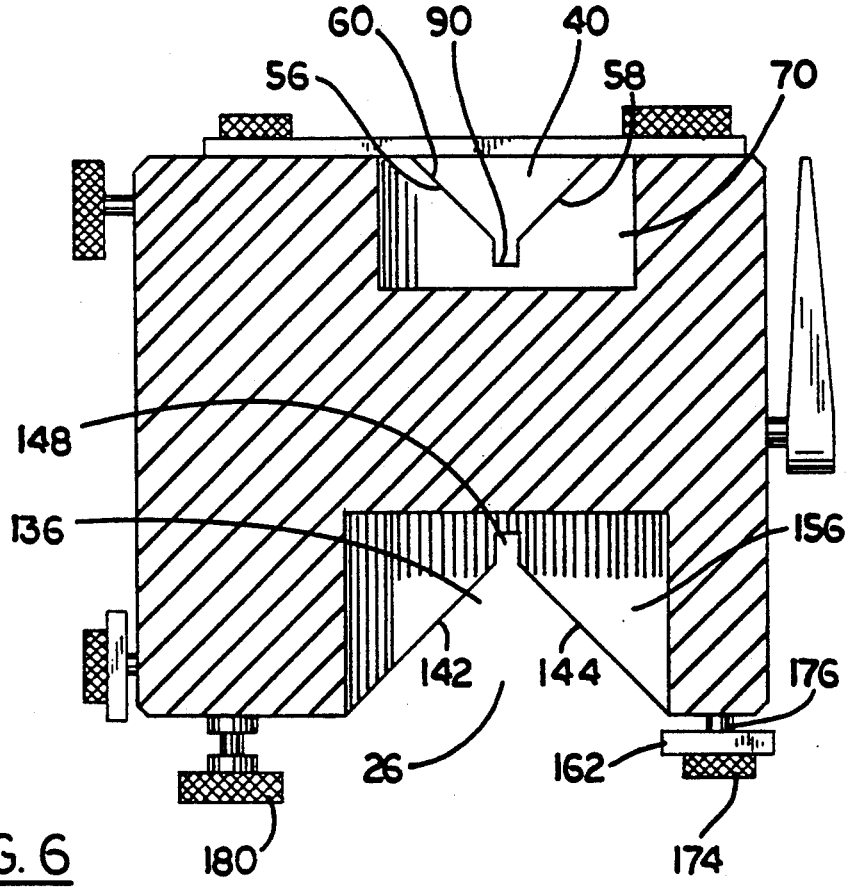
FIG. 6 is a bottom view of the punch and die grinding fixture shown in FIG. 1, viewed from plane 6—6.

As may be seen in FIG. 6, permanent cavity 26 is similar in construction to cavity 40, and includes V-groove 136 formed by angled walls 142 and 144, with their apex of intersection surrounded by trough 148. Below V-groove 136 is pocket 156.

For convenience of construction, bottom plate 158 provides the bottom wall for cavities 40 and 26, but the bottom walls of the cavities may also be provided by machining each bottom wall out of block 30.

Figure 7:
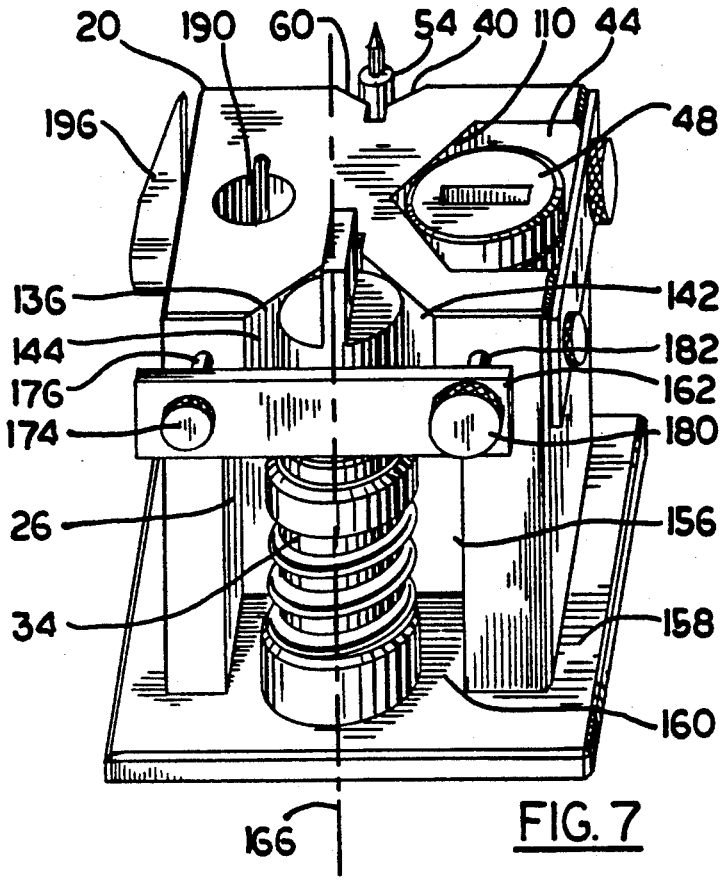
FIG. 7 a rear perspective view of the punch, die, and dressing post mounted in the fixture for grinding the punch and die and for dressing a grinding wheel.

Referring to FIGS. 2, 4, 5, 6, and 7, punch 34, mating die 48, and dressing post 54 are shown in FIG. 7, mounted in punch and die grinding fixture 20. The punch is pressed at the shank by pressing bar 162 in line contact along line 166, into V-groove 136, against walls 144 and 142. It rests on permanent bottom horizontal wall 160 which is in the same plane as permanent bottom horizontal wall 74.

Trough 148 provides clearance for pin 170. Line contact is facilitated by bar 162 being held pivotally between screw 174 and spacer 176 which together retain the bar on block 30. Bar 162 is able to rotate vertically across the block to behind draw-down thumb screw 180 which also has a spacer 182 (FIG. 7) so that the bar can accommodate the large diameter punch.

The widths of walls 142 and 144, and their included angle are such that the punch shank makes tangential contact with walls 142, 144 and with pressing bar 162, preventing movement of the shank when the bar is clamped down on the shank.

In like manner, dressing post 54 is clamped into V-groove 60 of cavity 40, and die 48 is clamped into V-groove 110 of cavity 44.

Line contact pressing by a flat surface to press the shank in the V-grooves may be provided by any suitable pressing means attached to the block, such as a lever type clamp for example, as long as the bar or other element having the flat surface is pivotally mounted to assure that it falls into line contact when drawn toward the block against the tool.

Vertical hole 190 accepts additional punches and dies, such as a standard 3-½" punch with 1" shank, and a 1" AMADA (tm) die. A punch or die in hole 190 is clamped in place by set screw 192 operated by arm 196.

FIG. 8 shows a punch and die mounted in fixture 20 for grinding by wheel 210 (in phantom). The heights of the bottom walls of the cavities for the punch and die are predetermined so that preferably the bottom wall for receiving the die is higher than the bottom wall for receiving the punch, and about 1" below the top of the cavity for receiving the punch, and the front cutter faces of the punch and die are above the tops of the cavities.

The resulting arrangement of the cutter faces of the punch and die is convenient for grinding the two tools in a single set-up. It may only be necessary to reset the wheel separately for each tool face. Fixture 20 assures that the tools will be ground with uniform faces, and in perfectly parallel planes.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. A punch and die grinding fixture for a punch having a front cutter face and shank toward the front of the punch and a spring head assembly toward the back of the punch, and a mating die having a front cutter face and a back, said fixture comprising:

a block having a top, a bottom, a first side, a second side, and comprising a first permanent cavity and a second permanent cavity, said first cavity being in said first side and comprising an upper portion and a lower portion, said upper portion comprising a pair of walls forming a first vertical V-groove for receiving the punch shank, said lower portion comprising a permanent pocket that is wider and deeper than said first vertical V-groove, for receiving with clearance, the spring head assembly of the punch, and a first permanent horizontal bottom wall in said pocket, for supporting the spring head assembly of the punch, said second cavity being in said second side and comprising a pair of walls forming a second vertical V-groove having an axis parallel to the axis of the first vertical V-groove, and a second permanent horizontal bottom wall higher than said first bottom wall, and a first means and a second means for pressing respectively said punch shank and said die into the respective first and second V-grooves by bearing respectively on said punch shank and said die normally to the center of the V-groove.

2. A punch and die grinding fixture for a punch having a spring head assembly, and a mating die, as described in claim 1, said fixture further comprising:

said first and second V-groove walls having widths such that said punch shank and die each make tangential contact with each of the walls of the respective V-groove in which it is situated, and with the respective means for pressing, a one of said means for pressing comprising a bar having a first end and a second end, said bar being pivotally attached at the first end to said block on one side of the V-groove, and means for drawing the second end of the bar toward the block on the other side of the V-groove, said means for drawing being attached to the block.

3. A punch and die grinding fixture for a punch having a spring head assembly, and a mating die, as described in claim 2, said fixture further comprising:

said bar comprising a flat surface and being so located on the block and spaced from the bottom of said V-groove so that the bearing is by said flat surface in a vertical contact line directly on said punch shank or die.

4. A punch and die grinding fixture for a punch having a spring head assembly, and a mating die, as described in claim 2, said fixture further comprising:

said bar attachment at the first end of a one of said bars also being rotatable in a vertical arc.

5. A punch and die grinding fixture for a punch having a spring head assembly, and a mating die, as described in claim 1, said fixture further comprising:

a trough surrounding the apex of a one of said V-grooves running the full length of the V-groove and spaced throughout from the apex of the V-groove.

6. A punch and die grinding fixture for a punch having a spring head assembly, and a mating die, as described in claim 1, said fixture further comprising:

the height of said second permanent horizontal bottom wall with respect to said first permanent horizontal wall being predetermined so that the front cutter faces of the punch and die are above the first and second cavities when the punch and die are mounted in the fixture with the backs of the punch and die respectively against the first and second horizontal bottom walls.

7. A punch and die grinding fixture for a punch having a spring head assembly, and a mating die, as described in claim 6, said fixture further comprising: means on said block for holding a dressing post parallel to said V-grooves, with the cutting end of the dressing post above said first and second cavities.

8. A punch and die grinding fixture for a punch having a spring head assembly, and a mating die, as described in claim 6, said fixture further comprising:

a vertical, cylindrical hole formed in the rop of said block, the axis of said cylindrical hole being parallel to said said V-grooves, and means for clamping an item within said cylindrical hole by applying force perpendicular to the axis of said cylindrical hole, attached to said block.

9. A punch and die grinding fixture for a punch having a cutter face and shank toward the front of the punch and a spring head assembly toward the back of the punch, and a mating die having a front cutter face and a back, said fixture comprising:

a block having a top, a bottom, a first side, a second side, a third side, and comprising a first permanent cavity, a second permanent cavity, and a third permanent cavity, said first cavity being in said first side and comprising an upper portion and a lower portion, said upper portion comprising a first vertical V-groove for receiving the punch shank, said lower portion comprising a permanent pocket that is wider and deeper than said first vertical V-groove, for receiving with clearance, the spring head assembly of the punch, and a first permanent horizontal bottom wall in said pocket, for supporting the spring head assembly of the punch, said first vertical V-groove being continuous from the top of said block to said permanent pocket, said second cavity being in said second side and comprising a second vertical V-groove having an axis parallel to the axis of the first vertical V-groove, and a second permanent horizontal bottom wall of predetermined height with respect to said first bottom wall, said second vertical V-groove being continuous from the top of said block to said second bottom wall, and a first means and a second means for pressing respectively said punch shank and said die into the respective first and second V-grooves by bearing in a vertical contact line, that is generally normal to the center of the V-groove, along a portion of said shank and said die, and said third cavity being in said third side and comprising an upper portion and a lower portion, said upper portion comprising a third vertical V-groove for receiving a punch shank, said lower portion comprising a second permanent pocket that is wider and deeper than said third vertical V-groove, for receiving with clearance, a spring head assembly of a punch, and a third permanent horizontal bottom wall in said second pocket, for supporting the spring head assembly of the punch, said third vertical V-groove being continuous from the top of said block to said second permanent pocket.

10. A punch and die grinding fixture as described in claim 9, further comprising:

said first and third permanent horizontal bottom walls being in the same plane and said second permanent horizontal bottom wall being higher than said first permanent horizontal bottom wall, and said third V-groove being shallower than said first and second V-grooves.

* * * * *